United States Patent [19]

Ichigaya et al.

[11] 3,950,671

[45] Apr. 13, 1976

[54] BEAM MISLANDING CORRECTING SYSTEM FOR COLOR CATHODE RAY TUBE

[75] Inventors: Koji Ichigaya, Toda; Hiromasa Machida, Mitaka; Masayuki Sudoh, Tokyo; Masami Mizuno, Yokohama; Yoriyoshi Awata, Tokyo, all of Japan

[73] Assignee: Sony Corporation, Tokyo, Japan

[22] Filed: Mar. 14, 1974

[21] Appl. No.: 451,306

[30] Foreign Application Priority Data

Mar. 19, 1973 Japan ..... 48-33610

[52] U.S. Cl. ..... 315/368; 315/370; 315/401

[51] Int. Cl.[2] ..... H01J 29/70; H01J 29/76

[58] Field of Search ..... 315/368, 370, 401

[56] References Cited

UNITED STATES PATENTS

| | | | |
|---|---|---|---|
| 3,398,319 | 8/1968 | Lemke et al. | 315/400 |
| 3,398,320 | 8/1968 | Hursh | 313/440 |
| 3,402,319 | 9/1968 | McDonald et al. | 315/401 |
| 3,424,942 | 1/1969 | Barbin | 315/368 |
| 3,668,464 | 6/1972 | Tokita et al. | 315/401 |

*Primary Examiner*—Maynard R. Wilbur
*Assistant Examiner*—T. M. Blum
*Attorney, Agent, or Firm*—Lewis H. Eslinger; Alvin Sinderbrand

[57] ABSTRACT

A system for compensating for mislanding of electron beams on the screen of a color cathode ray tube as a result of thermal expansion of a beam selecting structure in the tube comprises electromagnetic devices provided on the tube for producing respective magnetic fields by means of a current supplied thereto so as to change the paths of the electron beams passing through the beam selecting structure, and a circuit for supplying to the electromagnetic devices a current varying in response to a difference between the temperature of the beam selecting structure and the ambient temperature about the tube. The circuit for supplying a current to the electromagnetic devices may desirably include two temperature responsive elements, such as, variable resistors, respectively responding to variations in the temperature of the beam selecting structure and to variations in the ambient temperature about the tube, and preferably being connected in series across a voltage source with a connection point between the variable resistors being connected to the base electrode for controlling the current flowing through the collector-emitter path of the transistor to the electromagnetic devices.

11 Claims, 9 Drawing Figures

BEAM MISLANDING CORRECTING SYSTEM FOR COLOR CATHODE RAY TUBE

BACKGROUND OF THE INVENTION

1. Field of the Invention

This invention relates generally to a beam mislanding correcting system for a color cathode ray tube, and more particularly to a system for compensating for the mislanding of electron beams in a color cathode ray tube that results from thermal expansion of a beam selecting structure of the tube.

2. Description of the Prior Art

In a color cathode ray tube having a screen provided with arrays of color phosphors, there is provided a beam selecting structure, in the form of a mask or grille which has apertures or slits therethrough, to allow the electron beams to land only on the respective phosphors of the screen that emit light of selected colors. In such tubes, the impingement of the electron beams on the beam selecting structure generates heat in the tube by which the temperature of the beam selecting structure is increased. This increased temperature of the beam selecting structure causes thermal expansion or distortion thereof with the result that the positions of the apertures or slits are shifted relative to the respective groups of phosphors of the screen. This causes the landing positions of the electron beams on the screen to shift relative to the respective color phosphors, and such so-called mislanding causes deteriorations in color purity. The mislanding of the electron beams is more pronounced near the periphery of the screen than at the center thereof, and particularly becomes a serious problem in the case of wide beam deflection angle tubes.

Various ways have been proposed for compensating for such mislanding of the electron beams. One conventional way is to shift the position of the beam selecting structure in the tube relative to the screen in response to increasing temperature of the beam selecting structure, for example, by mounting the beam selecting structure by means of bimetallic supports. Another existing proposal is to shift the effective beam deflection center in the direction of the tube axis relative to the beam selecting structure, so as to change the incident angle of the beam in passing through the aperture or slit of the mask or grille. One existing way of shifting the effective beam deflection center invokes the use of an auxiliary beam deflection coil in addition to the main deflection coil, with the current supplied to the auxiliary beam deflection coil being varied in response to changes in the temperature of the beam selecting structure so as to vary the effect of the auxiliary beam deflection coil.

However, the above described existing systems have several drawbacks in that they are complicated in construction and expensive, and it is difficult for them to accurately compensate for mislanding over the whole screen area, that is, either insufficient or excess compensation is provided at various portions of the screen.

In copending U.S. Pat. application Ser. No. 329,049, filed Feb. 2, 1973, and having a common assignee herewith, permanently magnetic devices are disposed at several places on or in the tube to produce magnetic fields that change the electron beam paths so as to compensate for the electron beam mislanding. Each permanently magnetic device comprises a permanent magnet partially enclosed in a magnetic shunt structure that is temperature-responsive in the sense that the permeablility of the shunt changes in accordance with changes in temperature. However, the foregoing arrangement is disadvantageous to the extent that the strength of the magnetic fields produced by these permanently magnetic devices cannot be easily controlled or varied once they have been set.

Further, all of the above described existing compensation systems are undesirably affected by variations in the ambient temperature about the tube. The foregoing will be understood from the fact that the temperature of the beam selecting structure is varied in response to changes in the ambient temperature, whereby the apertures of slits of the beam selecting structure are shifted, and the temperature sensitive elements of the compensation system respond to the variations in the ambient temperature to shift the electron beam paths. However, the phosphors on the screen, which is usually made of glass, are also shifted by expansion or contraction of the screen in response to changes in the ambient temperature and, as a result, there may be no change in the positions of the shifted apertures or slits of the beam selecting structure relative to the positions of the shifted corresponding phosphors on the screen. Thus, changes in the electron beam paths in response to variations in the ambient temperature may result in incorrect compensation or mislanding.

SUMMARY OF THE INVENTION

Accordingly, it is an object of the present invention to provide a beam mislanding correcting system for a color cathode ray tube which correctly compensates for mislanding of the electron beams over the whole area of a screen of the tube caused by temperature variations in the beam selecting structure.

Another object is to provide a beam mislanding correcting system, as aforesaid, and which is controlled or adjusted to achieve proper compensation.

Still another object is to provide a beam mislanding correcting system, as aforesaid, and in which the compensation is prevented from being undesirable affected by variations in the ambient temperature about the tube.

In accordance with an aspect of this invention, compensation for thermally induced mislanding of the electron beams is provided by electromagnetic means disposed adjacent the color cathode ray tube and being operative, when supplied with current, to produce magnetic fields which change the paths of the electron beams passing through the beam selecting structure, and the current for such electromagnetic means in controlled in accordance with any difference between the ambient temperature about the tube and the temperature of the beam selecting means.

In a particular embodiment of the invention, the above mentioned electromagnetic means is comprised of coils, preferably wound on magnetic cores, and being disposed adjacent the funnel-like portion of the color cathode ray tube at the opposite sides thereof, considered in the line-scanning or horizontal direction, and the circuit for supplying the current to such coils includes two temperature responsive elements respectively responding to changes in the ambient temperature and in the temperature of the beam selecting structure, with such temperature responsive elements being connected in the circuit so that the current from the latter varies in accordance with changes in the difference between the respectively sensed temperatures.

The above, and other objects, features and advantages of the invention, will be apparent in the following detailed description of an illustrative embodiment thereof which is to be read in connection with the accompanying drawings.

DESCRIPTION OF THE PREFERRED EMBODIMENTS

Figure 1:
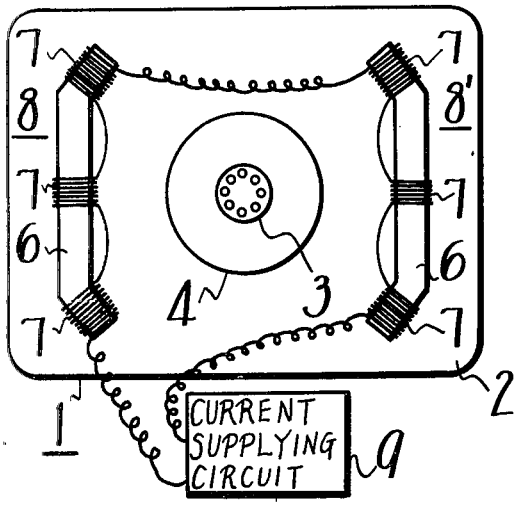
FIG. 1 is a schematic rear elevational view of a color cathode ray tube provided with a beam mislanding correcting system according to an embodiment of the present invention.
Figure 4:
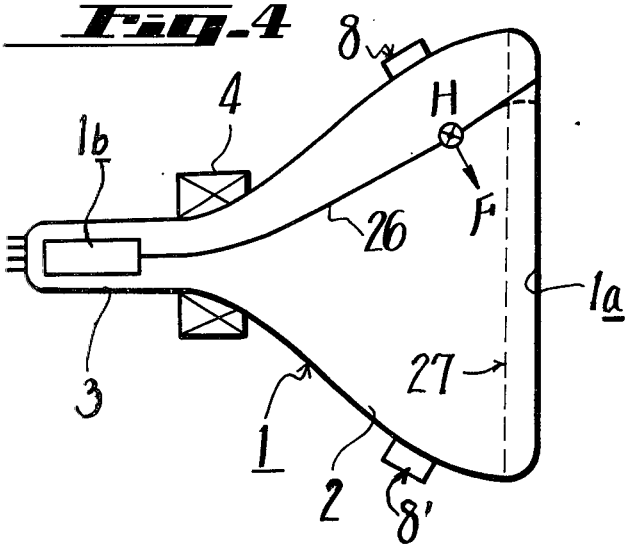
FIG. 4 is a schematic top plan view of the color cathode ray tube of FIG. 1, and illustrating the manner in which one of the electron beams therein is influenced by the beam mislanding correcting system of this invention.

Referring to the drawings in detail, and initially to FIGS. 1 and 4 thereof, it will be seen that a beam mislanding correcting system according to this invention is there shown applied to a conventional color cathode ray tube 1, for example, of a color television receiver, including the usual glass envelope having a flaring or funnel-like portion 2 extending from a neck portion 3 to a face plate which is provided, at its rear or inner surface, with a color phosphor screen 1*a*. An electron gun structure 1*b*, for example, of the type disclosed in U.S. Pat. No. 3,448,316, is disposed within neck portion 3 of the color cathode ray tube and directs a plurality of electron beams, only one of which is indicated at 26 on FIG. 4, against screen 1*a*. A beam selecting structure 27, for example, in the form of a mask or grille having a pattern of apertures or slits therein, is disposed within the color cathode ray tube 1 near screen 1*a*, and a deflecting coil assembly 4 is disposed on tube 1 for effecting horizontal and vertical deflections of the electron beams so that the latter will scan screen 1*a* in a predetermined raster. In the case where the screen 1*a* is constituted by arrays of color phosphors which respectively emit red, green and blue light when impinged upon by the respective electron beams, and which are arranged in groups or triads each associated with a respective aperture or slit of beam selecting structure 27, the so-called red, green and blue electron beams are made to converge at the plane of the beam selecting structure and then to diverge, after passing through an aperture or slit of structure 27, for impingement on the respective color phosphors of the corresponding group or triad.

The apertures or slits of beam selecting structure 27 are normally located therein relative to the corresponding groups of color phosphors on screen 1*a* so that, with beam selecting structure 27 at the ambient temperature about tube 1, each of the electron beams, in all deflected positions thereof, will correctly impinge or land on the respective color phosphor of the group or triad of color phosphors corresponding to the aperture or slit of the beam selecting structure through which the electron beam has passed. For example, as shown on FIG. 5, one of the electron beams, when deflected to travel along the path indicated in full lines at 26*a*, will pass through an aperture or slit 27*a* of the beam selecting structure and land at the correct position A on screen 1*a* at which a respective color phosphor is located. However, during operation of color cathode ray tube 1, the electron beams scanning screen 1*a* impinge on beam selecting structure 27 at the regions of the latter between the apertures or slits thereof and cause progressive heating of the beam selecting structure. Such heating of beam selecting structure 27 causes thermal expansion of the latter with the result that the apertures or slits in structure 27 are shifted outwardly relative to the center of the beam selecting structure with the outward shifting or displacement of the apertures or slits increasing progressively in accordance with the increasing temperature of struture 27 and also in accordance with increasing distance of the aperture or slit from the center of structure 27. In the case of a color cathode ray tube 1 having a face plate and screen 1*a* of substantially rectangular configuration, as illustrated on FIG. 1, the greatest shifting or displacement of the apertures of slits of beam selecting structure 27 relative to the respective groups or triads of color phosphors on screen 1*a* will obviously occur at the corner portions of the beam selecting structure and screen and at the opposite sides thereof considered in the horizontal or line scanning direction of the electron beams.

Figure 5:
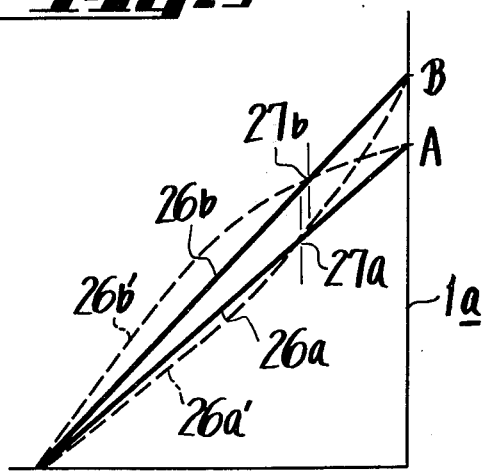
FIG. 5 is a diagrammatic view showing, on an enlarged scale, alternative ways in which beam mislanding may be corrected according to this invention.

When thermal expansion of beam selecting structure 27 causes shifting or displacement of its apertures or slits relative to the corresponding groups of color phosphors on screen 1*a*, for example, when aperture or slit 27*a* is shifted or displaced to the position 27*b* on FIG. 5, the beam 26 has to be deflected to the position indicated in full lines at 26*b* in order to pass through the shifted aperture or slit 27*b* and impinges or lands on screen 1*a* at the incorrect position B which is spaced from the correct landing position A at which the respective color phosphor is located. Such mislanding of the electron beam at the incorrect position B causes the respective electron beam to either inadequately excite the corresponding color phosphor and/or to excite a color phosphor corresponding to one of the other electron beams with the result that the purity and quality of the resulting color picture is deleteriously affected. Since the shifting or displacement of the apertures or slits in beam selecting structure 27 relative to the corresponding color phosphors on screen 1*a* is most pronounced at the corner portions and opposite side portions of the cathode ray tube, it is apparent that the beam mislanding will also be most pronounced at those portions.

Figure 2:
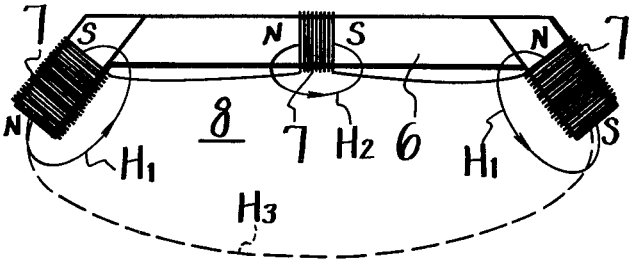
FIG. 2 is an enlarged schematic elevational view showing one example of an electromagnetic device used in the beam mislanding correcting system according to the present invention and illustrating the magnetic fields produced by such electromagnetic device.

In accordance with the present invention, the above described mislanding of the electron beams in color cathode ray tube 1 is corrected by providing the latter with electromagnetic devices 8 and 8' (FIG. 1) suitably mounted on or adjacent to the periphery of funnel-like portion 2 and being operative, when energized as hereinafter described in detail, to produce auxiliary beam deflection magnetic fields by which compensatory deflections are imparted to the electron beams, particularly when scanning the corner and side portions of screen 1*a*. As shown, each of electromagnetic devices 8 and 8' includes a magnetic core 6 of a material having a low coercive force, such as, for example, a silicon steel containing 3 wt.% silicon, and a plurality of coils 7 wound on the core. Preferably, the core 6 is of elongated configuration and has inwardly inclined end portions with the coils 7 being wound at least on such inwardly inclined end portions of the respective core 6 and also, if necessary, on the central portion of the core, as shown on FIGS. 1 and 2. The electromagnetic devices 8 and 8' are arranged substantially vertically at opposite sides of tube 1 so that the coils 7 on the inwardly inclined end portions of the respective cores 6 will be located adjacent the corner portions of the tube. Further, as particularly shown on FIG. 4, electromagnetic devices 8 and 8' are preferably disposed on funnel-like portion 2 at the side of beam selecting structure 27 facing away from screen 1*a* so that the magnetic fields produced by current flowing through coils 7 will act on the electron beams, particularly when deflected toward the corner and side portions of the tube, as the beams near beam selecting structure 27.

All of the coils 7 of electromagnetic devices 8' are connected in series with each other to a current supplying circuit 9 (FIGS. 1 and 7) which, as hereinafter described in detail, supplies to coils 7 a current which varies in accordance with the shifting or displacement of the apertures or slits of beam selecting structure 27 relative to the corresponding color phosphors of screen 1*a* as a result of heating and consequent thermal expansion of structure 27.

It will be apparent that the supplying of such current to coils 7 results in the production of magnetic fields $H_1$ and $H_2$ at the inwardly inclined end portions and central portion, respectively, of the core 6 of each electromagnetic device (FIG. 2), with the flux densities of such magnetic fields $H_1$ and $H_2$ being varied in response to changes in the current supply to coils 7. By reason of the described locations of electromagnetic devices 8 and 8' and the configurations of their respective cores 6, the electron beams, when deflected by deflection coil assembly 4 so as to land on a corner portion of screen 1*a*, pass through a respective one of the magnetic fields $H_1$ which has its magnetic lines of flux extending substantially perpendicular to the beam paths. Similarly, when the electron beams are deflected by deflection coil assembly 4 so as to land on a side portion of screen 1*a* adjacent a horizontal line extending through the center of the screen, the electron beams pass through a respective one of the magnetic fields $H_2$ whose magnetic lines of flux extend substantially perpendicular to the electron beam paths.

Referring now to FIG. 4, it will be apparent that, when no current is supplied to coils 7 of electromagnetic devices 8, the electron beam 26 deflected by deflection coil assembly 4 to impinge on a corner or side portion of screen 1*a* will be uninfluenced by any correcting magnetic field from either of the devices 8 and 8' and will follow the path indicated in full lines. However, when a current is supplied to coils 7 so that electron beam 26 passes through a correcting magnetic field H having its lines of magnetic flux extending perpendicular to the plane of the drawing, the beam 26 is subjected to a force in the direction of the arrow F on FIG. 4, and consequently is deflected to follow the path indicated in broken lines. Thus, if one considers the situation illustrated on FIG. 5 in which, due to thermal expansion of beam selecting structure 27, an aperture or slit of the beam selecting structure is shifted or displaced from the position indicated at 27*a* to the position indicated at 27*b*, it will be apparent that, by supplying a suitable current to coils 7, the resulting correcting magnetic field may deflect the electron beam passing through aperture or slit 27*b* from the path 26*b* which results in mislanding of the beam at the incorrect position B, to the bent or deflected path indicated in broken lines at 26*b'* which, upon passage through the shifted or displaced aperture or slit 27*b* results in proper landing of the electron beam at the correct position A. Thus, the supplying of a current to coils 7 of electromagnetic devices 8 and 8' which varies in accordance with the thermally induced shifting or displacement of the apertures or slits of beam selecting structure 27 relative to the respective color phosphors on screen 1*a* may be effective to correct the mislanding of the beams that would otherwise result therefrom.

In the above description of the operation of electromagnetic devices 8 and 8' in correcting for beam mislanding, it has been assumed that the current supplied to coils 7, and hence the magnetic flux density of the respective correcting magnetic fields increases with increasing shifting or displacement of the apertures or slits of beam selecting structure 27 relative to the respective color phosphors on screen 1*a*, and further that the direction of the current flow through coils 7 is such as to produce respective magnetic fields which act inwardly, that is, in the direction opposed to the shifting or displacement of the apertures or slits, upon the electron beams passing through such fields. However, in an electron beam mislanding correcting system according to this invention, the reverse arrangement may be employed, that is, the current supplied to coils 7 of electromagnetic devices 8 and 8' may have a predetermined maximum value when beam selecting structure 27 is at ambient temperature to produce respective relatively strong magnetic fields acting outwardly on the electron beams passing therethrough, with the current supplied to coils 7 being reduced progressively in accordance with the shifting or displacement of the apertures or slits of structure 27 relative to the respective color phosphors of screen 1*a* so as to correspondingly reduce the extent of the deflections of the electron beams passing through the respective correcting magnetic fields. With such a reverse arrangement according to this invention, the correct landing position for the electron beam would be that indicated at B on FIG. 5, and the beam would follow the deflected path indicated in broken lines at 26*a'* to impinge or land at the correct position B when the beam selecting structure is at ambient temperature, that is, when the aperture or slit is at the position indicated at 27*a*, and the thermally induced shifting of the aperture or slit to the position 27*b* would be accompanied by a corresponding decrease in the flux density of the correcting magnetic field so that the beam would then follow the path indicated in full lines at 26*b* for passage through the aperture or slit 27*b* and landing at the correct position B.

Figure 3:
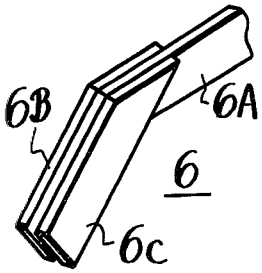
FIG. 3 is a fragmentary perspective view of a portion of the core of the electromagnetic device of FIG. 2.

In order to ensure that the desired correcting magnetic fields $H_1$ and $H_2$ produced by coils 7 in response to the flow of current therethrough have flux densities that are large relative to the flux density of a magnetic field $H_3$ (FIG. 2) that may be established between the opposite ends of core 6, it is desirable that a low magnetic reluctance of the core 6 be avoided. Such low magnetic reluctance of core 6 as would provide magnetic field $H_3$ with a substantial flux density can be be avoided either by providing the central and inclined end portions of core 6 with apertures extending therethrough, or, as shown particularly on FIG. 3, by forming the inclined end portions of magnetic core 6 of a magnetic plate 6A laminated between two magnetic plates 6B and 6C of a material having a magnetic reluctance less than that of the middle plate 6A.

In practical examples of the present invention, the magnetic core 6 of each electromagnetic device 8 or 8′ has a width of about 15mm, a thickness of about 0.2 to 1.0mm, a length in the range from about 100 to 250mm, depending upon the side of the color cathode ray tube 1, and inclined end portions at angles of about 60° from the direction of the central portion of the core. Further, in such practical examples of the invention, the coils 7 wound on the central and end portions of core 6 have from about 1000 to 2500 turns.

It should be noted that the extent to which an aperture or slit of beam selecting structure 27 is shifted or displaced relative to the respective color phosphors of screen 1*a* so as to cause beam mislanding is proportionate to the difference between the temperature of beam selecting structure 27 and the ambient temperature about tube 1. The temperature of beam selecting structure 27 is, of course, the sum of the temperature due to the heat which is generated by impingement of the electron beams on structure 27, and the ambient temperature about tube 1. However, the face plate of tube 1 having screen 1*a* thereon is also influenced by the ambient temperature, that is, the ambient temperature may also cause thermal expansion or contraction of the face plate with consequent changes in the positions of the color phosphors thereon. Thus, if the ambient temperature alone is considered, it will be apparent that an increase in the ambient temperature will cause shifting or displacement of the apertures or slits in beam selecting structure 27 and also corresponding shifting or displacement of the positions of the respective color phosphors of screen 1*a*. It will be clear that such corresponding shifting of the slits or apertures of structure 27 and of the corresponding color phosphors of screen 1*a* as a result of changes in the ambient temperature will not cause beam mislanding as the positional relationship of the apertures or slits and of the color phosphors does not change.

Figure 6:
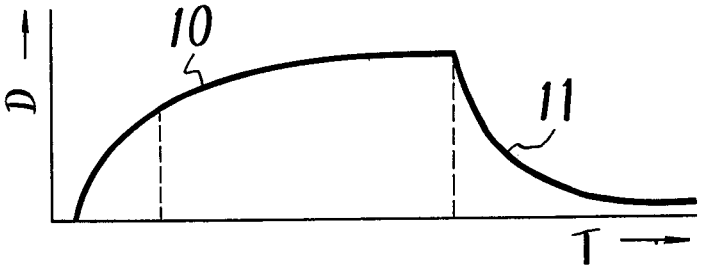
FIG. 6 is a graph showing the shifting or displacement of the apertures or slits in a beam selecting structure relative to the respective color phosphors on the screen as a function of time considered from the commencement and discontinuance of operation of the color cathode ray tube.

From the foregoing, it will be apparent that, in order to effect accurate correction of electron beam mislanding, the current supplied to coils 7 of electromagnetic devices 8 and 8′ has to be varied in accordance with only the change in the temperature of beam selecting structure 27 that results from the impingement of the electron beams thereon, which temperature is the difference between the actual temperature of beam selecting structure 27 and the ambient temperature about tube 1. This temperature difference increases exponentially with time following the commencement of operation of cathode ray tube 1 and, when the operation of tube 1 is discontinued, the temperature difference decreases exponentially with time. As a result of the foregoing, the shifting or displacement of the apertures or slits of beam selecting structure 27 relative to the corresponding color phosphors of screen 1*a*, and which is indicated at D on FIG. 6, increases with time following the commencement of operation of tube 1 as indicated by the curve 10, and such relative shifting or displacement decreases with time following the discontinuance of operation of the tube, as indicated by the curve 11 on FIG. 6. Therefore, the electromagnetic devices 8 and 8′ of the system according to this invention can produce correcting magnetic fields $H_1$ and $H_2$ sufficient to accurately and fully correct or compensate for beam mislanding if the current supplying circuit 9 is arranged to supply to coils 7 a current which varies with time generally in accordance with the curves 10 and 11 on FIG. 6.

Figure 7:
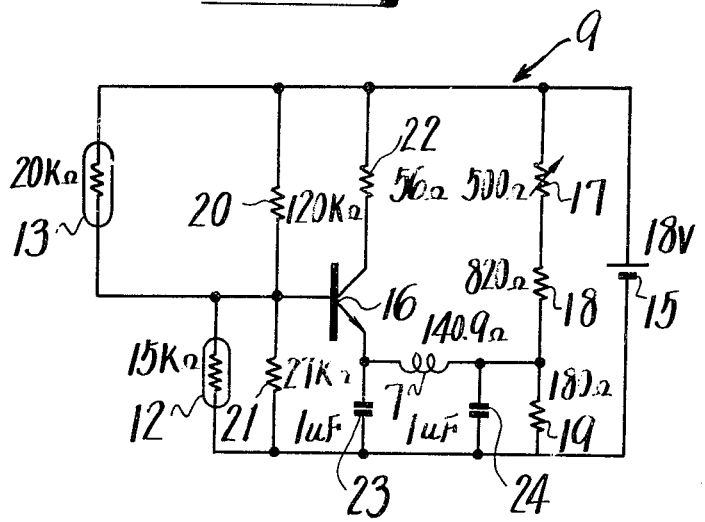
FIG. 7 is a schematic circuit diagram showing one example of a current supplying circuit employed in the beam mislanding correcting system.

An arrangement of the current supplying circuit 9 suitable for obtaining such variation of the current supplied to coils 7 is shown on FIG. 7 to include temperature responsive elements 12 and 13, for example in the form of thermistors. In the circuit arrangement of FIG. 7, thermistors 12 and 13 have negative temperature coefficients of resistance and are located so as to detect or respond to changes in the ambient temperature and changes in the temperature of the beam selecting structure 27, respectively. For example, thermistor 12 for detecting the ambient temperature about tube 1 may be attached to the chassis of the respective color television receiver, while thermistor 13 may be attached to the core of the horizontal and vertical deflecting coil assembly 4 which undergoes temperature changes similar to those of the beam selecting structure 27. Thermistors 12 and 13 are connected in series between the terminals of a power or voltage source, for example, a D.C. voltage source 15, and a connection point between thermistors 12 and 13 is connected to the base electrode of a transistor 16. A variable resistor 17 and resistors 18 and 19 are connected in series between the terminals of voltage source 15, and the series connected coils 7 of electromagnetic devices 8 and 8′ represented by a single coil 7 on FIG. 7 are connected between the emitter electrode of transistor 16 and a connection point between resistors 18 and 19. Further, as shown, current supplying circuit 9 includes resistors 20 and 21 connected between the base electrode of transistor 16 and the opposite terminals of voltage source 15, a resistor 22 connected between one terminal of voltage source 15 and the collector electrode of transistor 16, and capacitors 23 and 24 connected between the other terminal of voltage source 15 and the opposite ends of the series connected coils 7.

It will be apparent that, with the arrangement of the current supplying circuit 9 shown on FIG. 7, the current flowing through the collector-emitter path of transistor 16, and hence through the series connected coils 7 of electromagnetic devices 8 and 8′, is dependent on the potential or voltage applied to the base electrode of transistor 16, and is also dependent on the setting of the variable resistor 17 which, in combination with the resistor 18, provides an alternative path for the current in parallel with resistor 22, the collector-emitter path of transistor 16 and coil 7. Further, it will be apparent that the base potential or voltage of transistor 16 is dependent on the relative resistance values of thermistors 12 and 13, which resistance values respectively correspond to the ambient temperature and the temperature of beam selecting structure 27. Thus, the base potential or voltage of transistor 16 is varied in accordance with the difference between the temperature of beam selecting structure 27 and the ambient temperature, and the coils 7 are supplied with a current that is proportional to such temperature difference, and hence proportional to the shift or displacement of the slits of apertures of beam selecting structure 27 relative to the corresponding color phosphors of screen 1*a*. To the extent that tolerances or errors occurring in the manufacturing of the color cathode ray tube 1 results in mislanding of the electron beams even when the temperature of beam selecting structure 27 is the same as the ambient temperature, variable resistor 17 may be adjusted to provide an initial suitable compensating or correcting current through coils 7 which corrects for the mislanding even when thermistors 12 and 13 detect the same temperatures.

Figure 9:
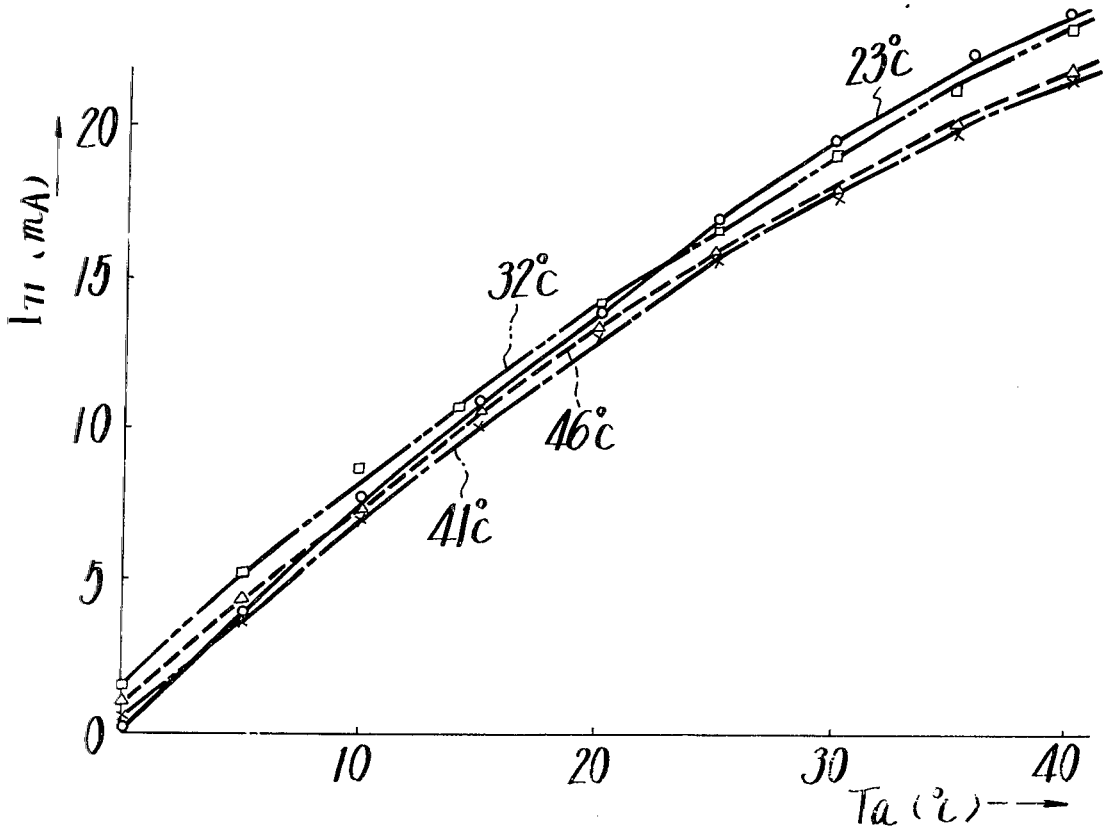
FIG. 9 is a graph showing variations of the current supplied to the electromagnetic devices as a function of the temperature of the beam selecting structure for various ambient temperatures.
Figure 8:
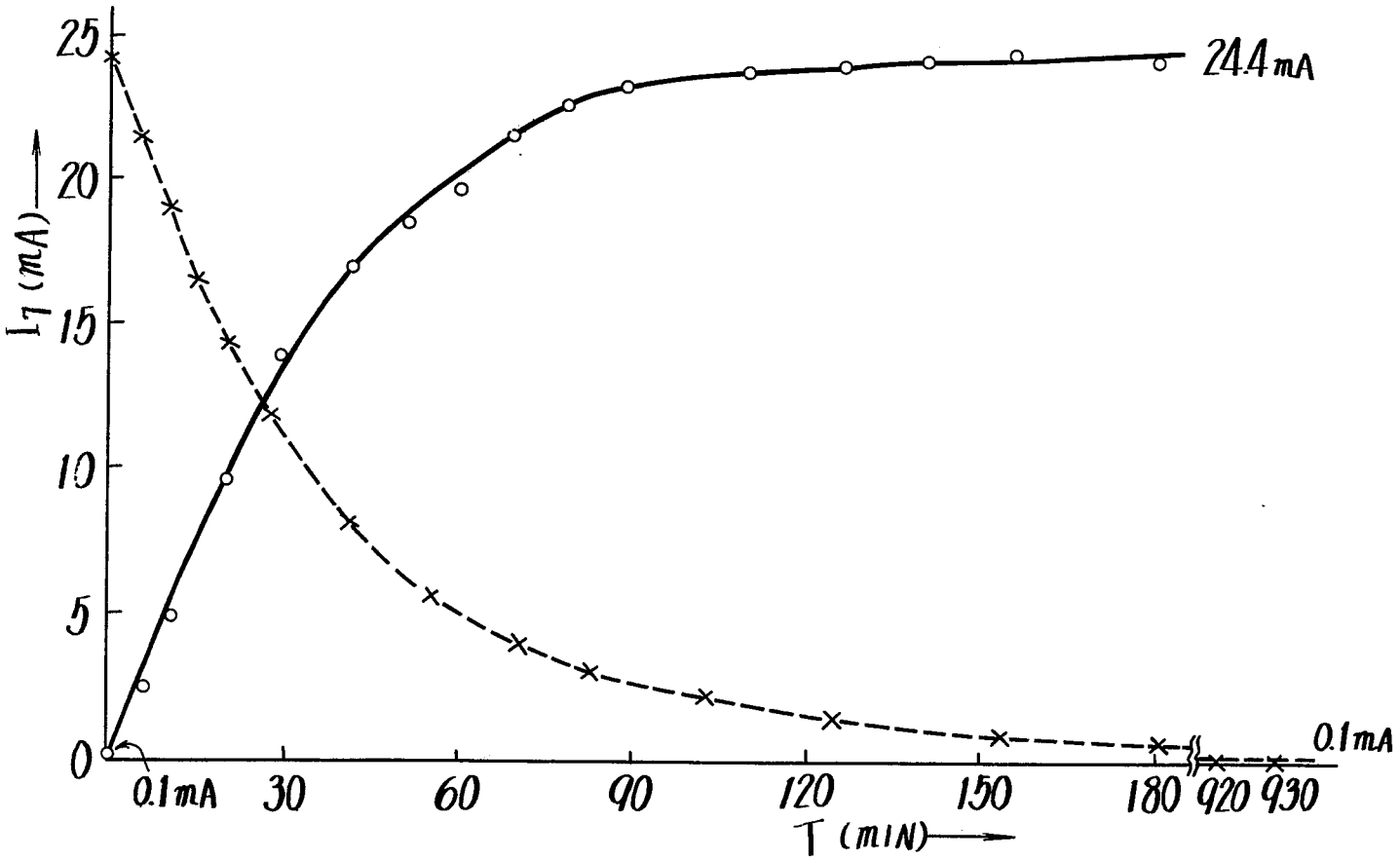
FIG. 8 is a graph showing variations of the current supplied to electromagnetic devices of the beam mislanding correcting system as a function of time considered from the commencement and discontinuance of operation of the color cathode ray tube at normal ambient temperature.

With the various elements of current supplying circuit 9 having the values shown on FIG. 7, with the indicated resistance values for thermistors 12 and 13 being those at normal or room temperature (about 20° C), the current $I_7$ flowing through coils 7 of electromagnetic devices 8 and 8' associated with a color cathode ray tube in accordance with this invention increases with the passage of time T from the commencement of operation of the tube in accordance with the curve shown in full lines on FIG. 8. Further, after long continued operation of the color cathode ray tube, the current flowing through coils 7 decreases with time following the discontinuance of operation of the tube in accordance with the curve drawn in broken lines on FIG. 8. Further, reference to FIG. 9 will show that, with the circuit arrangement of FIG. 7, the current $I_{71}$ flowing through coils 7 is substantially dependent on the temperature difference $T_a$ between the temperature of beam selecting structure 27 and the ambient temperature, and is substantially uninfluenced by changes in the ambient temperature. Thus, the curves labelled 23° C., 32° C., 41° C. and 46° C. on FIG. 9 which represent the relation of the current $I_{71}$ to the temperature difference $T_a$ for various corresponding ambient temperatures are seen to be closely proximate to each other. From the foregoing, it will be apparent that the correcting magnetic fields produced by the current $I_{71}$ flowing through coils 7 of electromagnetic devices 8 and 8' are substantially unaffected by changes in the ambient temperature, and can provide the desired accurate correction of mislanding which results from shifting or displacement of the apertures or slits of beam selecting structure 27 relative to the corresponding color phosphors of screen 1*a*.

Since the beam mislanding correcting system according to this invention, as described above, merely involves the provision of the color cathode ray tube with the suitably located electromagnetic devices 8 and 8' and the supplying to the coils 7 of such electromagnetic devices of a current that is suitably varied, mislanding of the beams, whether by reason of thermal expansion of beam selecting structure 27 or by reason of manufacturing tolerances or errors, can be easily corrected. Since the current supplying circuit 9 according to this invention changes the current supplied to coils 7 in accordance with the difference between the temperature of beam selecting structure 27 and the ambient temperature, the resulting magnetic fields have their flux densities varied accurately in accordance with the shifting or displacement of the apertures or slits of beam selecting structure 27 relative to the corresponding color phosphors of screen 1*a* for correcting mislanding without inaccuracies resulting from changes in the ambient temperature.

It should also be noted that the variable resistor 17 of current supplying circuit 9 makes it possible to initially adjust the beam mislanding correcting system according to this invention for variations between the thermal expansion characteristics of the beam selecting structures of various color cathode ray tubes, as well as for initial landing errors resulting from manufacturing tolerances or errors, as previously described.

Although illustrative embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A system for correcting mislanding of electron beams on the color phosphor screen of a color cathode ray tube which contains a beam selecting structure disposed near the screen and through which the electron beams pass for landing on the screen during scanning of the latter by said beams; said system comprising electromagnetic means including coil means for producing magnetic fields in response to a current flowing in said coil means, said electromagnetic means being located adjacent said tube for the passage of said electron beams through said magnetic fields so as to change the paths of said beams through said beam selecting structure and thereby correct for mislanding of the beams on said screen; first temperature detecting means for detecting the temperature of said beam selecting structure; second temperature detecting means spaced from said first temperature detecting means for detecting the ambient temperature about said tube; and circuit means for supplying said current to said coil means; said circuit means including means for varying said current in accordance with changes in the difference between the temperatures respectively detected by said first and second temperature detecting means.

2. In a color cathode ray tube including a color phosphor screen upon which electron beams impinge, a beam selecting structure disposed near the screen and through which said electron beams pass for landing on the screen during a scanning operation, and main deflection means for causing said beams to scan said screen, a system for correcting mislanding of said electron beams on said screen comprising a pair of magnetic cores disposed on opposite sides of said cathode ray tube and positioned between said main deflection means and said beam selecting structure, each of said magnetic cores including a central portion aligned substantially perpendicular to a beam scan line and respective end portions inclined inwardly toward said tube; coil means wound at least on each of said core end portions so as to produce, when energized, magnetic lines of flux which extend substantially perpendicular to the electron beam paths, the magnetic field produced by said coil means being relatively greater at said respective core end portions; and circuit means for supplying a variable energizing current to said coil means, said circuit means including first and second temperature detecting means which are spaced apart for detecting substantially the temperature of said beam selecting structure and substantially the ambient temperature about the tube, rspectively, and means for varying the magnitude of said current in accordance with changes in the difference between the temperatures respectively detected by said first and second temperature detecting means.

3. A system for correcting mislanding of electron beams on the color phosphor screen of a color cathode ray tube which contains a beam selecting structure disposed near the screen and through which the electron beams pass for landing on the screen during scanning of the latter by said beams; said system comprising electromagnetic means including coil means for producing magnetic fields in response to a current flowing in said coil means, said electromagnetic means being located adjacent said tube for the passage of said electron beams through said magnetic fields so as to change the paths of said beams through said beam selecting structure and thereby correct for mislanding of the beams on said screen; first temperature detecting means for detecting the temperature of said beam selecting structure; second temperature detecting means for detecting the ambient temperature about said tube; and circuit means for supplying said current to said coil means; said circuit means including a voltage source, a transistor having a collector-emitter path through which said coil means is connected with said voltage source, and a base-bias circuit for said transistor including said first and second temperature detecting means for varying said current in accordance with changes in the difference between the temperatures detected by said first and second temperature detecting means.

4. A system according to claim 3; in which said first and second temperature detecting means are respectively first and second temperature variable resistors responsive to said temperature of the beam selecting structure and said ambient temperature, respectively.

5. A system according to claim 4; in which said first and second temperature variable resistors are connected in series across said voltage source, and said transistor has a base electrode connected to a connecting point between said first and second temperature variable resistors.

6. A system according to claim 1; in which said circuit means includes means for adjustably varying said current independently of said temperature of the beam selecting structure and said ambient temperature.

7. A system according to claim 1; in which said color cathode ray tube has a substantially rectangular face plate on which said color phosphor screen is disposed, and in which said electromagnetic means are located in respect to said tube for the passage of said electron beams through said magnetic fields when said beams scan at least corner portions of said screen on said substantially rectangular face plate.

8. A system according to claim 7; in which said electromagnetic means includes two magnetic cores disposed at opposite sides of said tube and having said coil means wound thereon.

9. A system according to claim 8; in which each of said cores is elongated in the direction generally perpendicular to the line scanning direction of said electron beams and has inwardly inclined opposite end portions, and said coil means includes a plurality of coils wound on at least said inclined end portions of each of said cores.

10. A system according to claim 9; in which said substantially rectangular face plate is substantially larger in said line scanning direction than in the direction perpendicular thereto, and said coil means further includes coils wound on said cores intermediate said end portions of the latter.

11. A system according to claim 10; in which all of said coils are connected in series to receive said current from said circuit means.

* * * * *